US008722592B2

(12) United States Patent
Matulewicz et al.

(10) Patent No.: US 8,722,592 B2
(45) Date of Patent: May 13, 2014

(54) USE OF TRIAZOLES IN REDUCING COBALT LEACHING FROM COBALT-CONTAINING METAL WORKING TOOLS

(75) Inventors: William N. Matulewicz, West Chester, OH (US); Peter F. Vogt, Loveland, OH (US); Thomas J. Bobinger, Cincinnati, OH (US)

(73) Assignee: Wincom, Inc., Blue Ash, OH (US)

( * ) Notice: Subject to any disclaimer, the term of this patent is extended or adjusted under 35 U.S.C. 154(b) by 939 days.

(21) Appl. No.: 12/180,066

(22) Filed: Jul. 25, 2008

(65) Prior Publication Data

US 2010/0022424 A1 Jan. 28, 2010

(51) Int. Cl.
*C10M 133/44* (2006.01)

(52) U.S. Cl.
USPC ..... 508/281

(58) Field of Classification Search
USPC ..... 508/280, 281
See application file for complete search history.

(56) References Cited

U.S. PATENT DOCUMENTS

| | | | | | |
|---|---|---|---|---|---|
| 3,537,999 | A | | 11/1970 | Kennedy | |
| 3,790,481 | A | * | 2/1974 | Byford et al. | 508/281 |
| 3,833,502 | A | | 9/1974 | Leary | |
| 4,060,491 | A | * | 11/1977 | Bridger et al. | 508/280 |
| 4,066,821 | A | | 1/1978 | Cook et al. | |
| 4,144,188 | A | | 3/1979 | Sato | |
| 4,178,253 | A | | 12/1979 | Lee et al. | |
| 4,315,889 | A | * | 2/1982 | McChesney et al. | 422/7 |
| 4,406,811 | A | | 9/1983 | Christensen et al. | |
| 4,675,158 | A | | 6/1987 | Klindera | |
| 4,701,273 | A | | 10/1987 | Brady et al. | |
| 4,734,209 | A | | 3/1988 | Phillips et al. | |
| 4,744,950 | A | | 5/1988 | Hollander | |
| 4,976,919 | A | | 12/1990 | Skold et al. | |
| 5,126,397 | A | | 6/1992 | Horodysky et al. | |
| 5,219,523 | A | | 6/1993 | Vanderpool et al. | |
| 5,378,373 | A | | 1/1995 | Hollander | |
| 5,484,542 | A | * | 1/1996 | Cahoon et al. | 508/186 |
| 5,580,482 | A | | 12/1996 | Chasan et al. | |
| 5,597,514 | A | | 1/1997 | Miksic et al. | |
| 5,622,922 | A | | 4/1997 | Clarke et al. | |
| 5,723,061 | A | * | 3/1998 | Ciardi et al. | 252/79 |
| 5,746,947 | A | * | 5/1998 | Vanderpool et al. | 252/394 |
| 5,750,053 | A | | 5/1998 | Miksic et al. | |
| 5,773,627 | A | | 6/1998 | Anderson et al. | |
| 5,874,026 | A | | 2/1999 | Pilsits, Jr. et al. | |
| 5,874,390 | A | | 2/1999 | Gong et al. | |
| 5,922,978 | A | | 7/1999 | Carroll | |

(Continued)

OTHER PUBLICATIONS

Wells, Peter F., "Commercial Triazoles and Their Properties," AWT Meeting in Palm Springs, Sep. 21-24, 2005; AWT Journal of Spring 2007, vol. 14, No. 2, pp. 24-35.

*Primary Examiner* — Taiwo Oladapo
(74) *Attorney, Agent, or Firm* — Eric W. Guttag; Eric W. Guttag IP Law Office

(57) ABSTRACT

A method using one or more of certain triazoles in an amount effective to reduce cobalt leaching during a metal working process from a metal working tool comprising cobalt, such as tungsten carbide particles bonded by cobalt, wherein the one or more triazoles comprise at least butyl-benzotriazole, and optionally one or more other benzotriazoles. Also, a composition is provided which comprises a metal working fluid and one or more of these triazoles in an amount effective to reduce cobalt leaching from metal working tools comprising cobalt, such as tungsten carbide particles bonded by cobalt.

19 Claims, 2 Drawing Sheets

(56) References Cited

U.S. PATENT DOCUMENTS

| | | | |
|---|---|---|---|
| 5,958,849 | A | 9/1999 | Hewson et al. |
| 6,448,207 | B1 | 9/2002 | Fukutani et al. |
| 6,448,749 | B2 | 9/2002 | Pochmuller |
| 6,551,552 | B1 | 4/2003 | Lyublinski et al. |
| 6,706,670 | B2 | 3/2004 | Kalota et al. |

* cited by examiner

USE OF TRIAZOLES IN REDUCING COBALT LEACHING FROM COBALT-CONTAINING METAL WORKING TOOLS

BACKGROUND

1. Field of the Invention

The present invention generally relates to a method for reducing cobalt leaching from metal working tools comprising cobalt, such as metal working tools comprising tungsten carbide particles bonded by cobalt, by contacting the metal working tool comprising cobalt with one or more triazoles which comprise at least butyl-benzotriazole in an amount effective to reduce such cobalt leaching during a metal working process from the metal working tool. The present invention also generally relates to a composition comprising a metal working fluid and one or more triazoles which comprise at least butyl-benzotriazole in an amount effective to reduce cobalt leaching from a metal working tool comprising cobalt, such as tungsten carbide particles bonded by cobalt.

2. Related Art

A large percentage of industrial cutting tools used to drill, cut, grind, and mill metals are made of tungsten carbide particles held together by a cobalt bonding agent. The mechanical working of hard metals, such as cemented carbides containing cobalt, by, for example, grinding the cobalt-containing hard metals, is often carried out in the presence of a metal working fluid (sometimes referred to as a "cutting fluid"). Metal working fluids may fulfill one or more functions in various metal working applications. These functions may include removal of heat from the work piece and tool (cooling), reduction of friction among the metal chips, tool and work piece (lubrication), removal of metal debris produced during the metal working process, reduction or inhibition of corrosion, reduction or prevention of the build-up of material on edges between the workpiece and the tool, etc. For example, in drilling, cutting, milling, etc., this metal working fluid may act as a coolant and/or lubricant at the area of contact between the metal surface being machined (worked) and the drilling, cutting or milling tool.

Although water or mineral oil may be used alone as a coolant or lubricant, the practice has been to add compounds to the metal working fluid to increase the lubricity and cooling ability of the fluid and to delay its deterioration. For example, these metal working fluids may include an additional lubricant, such as a fatty acid salt, and may also contain iron corrosion inhibitors, such as salts of triethanol amine. Some amines including alkanolamines and arylalkylamines such as p-benzylaminophenol have also been found useful in metal working fluids as antibacterial agents. See EPO 90-400732 to Noda et al. which is referred to in the Background section of U.S. Pat. No. 6,706,670 (Kalota, et al.), issued Mar. 16, 2004. See also U.S. Pat. No. 4,144,188 to Sato, issued Mar. 13, 1979 (also referred to in the Background section of U.S. Pat. No. 6,706,670) which adds to metal working fluids dissolving tablets containing primary amides, ethylenediamine tetraacetic acid, fatty acid esters, and alkanolamine salts to replenish such compounds during the useful life of the fluid.

When cutting, drilling or milling tools which are made up of tungsten carbide particles bonded with cobalt metal are exposed to these metal working fluids, the cobalt may be leached away. Leaching of the cobalt matrix from the tool leaves a residue of carbide particles and may result in premature failure of the tool. This problem of cobalt leaching may be further exacerbated by the metal working process itself. During metal working, a large quantity of metal chips may be produced having a large surface area which, when exposed to the metal working fluid, participate in the corrosion and leaching processes, such that the content of ionic cobalt in solution in an aqueous metal working fluid may reach levels several hundreds of milligrams, per liter of metal working fluid. See Background section of U.S. Pat. No. 4,976,919 (Skold et al.), issued Dec. 11, 1990.

SUMMARY

According to a first broad aspect of the present invention, there is provided a method comprising the following steps:

a) providing a composition comprising one or more triazoles in an amount effective to reduce cobalt leaching from a metal working tool comprising cobalt, wherein the one or more triazoles comprise at least butyl-benzotriazole and optionally one or more other benzotriazoles, wherein the other benzotriazoles have the formula:

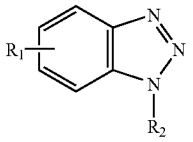

wherein $R_1$ is one or more of H, a halo group, an aliphatic group other than butyl, an aromatic group or a mixture thereof, and $R_2$ is H, an aliphatic group, an aromatic group or a mixture thereof, and (b) contacting a metal working tool with the composition of step (a) during a metal working process, wherein the metal working tool comprises cobalt.

According to a second broad aspect of the present invention, there is provided a composition comprising: a metal working fluid; and one or more triazoles in an amount effective to reduce cobalt leaching from a metal working tool comprising cobalt, wherein the one or more triazoles comprise at least butyl-benzotriazole and optionally one or more benzotriazoles, wherein the other benzotriazoles have the formula:

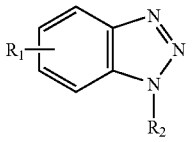

wherein $R_1$ is one or more of H, a halo group, an aliphatic group other than butyl, an aromatic group or a mixture thereof, and $R_2$ is H, an aliphatic group, an aromatic group or a mixture thereof

BRIEF DESCRIPTION OF THE DRAWINGS

The invention will be described in conjunction with the accompanying drawings, in which.

DETAILED DESCRIPTION

Figure 1:
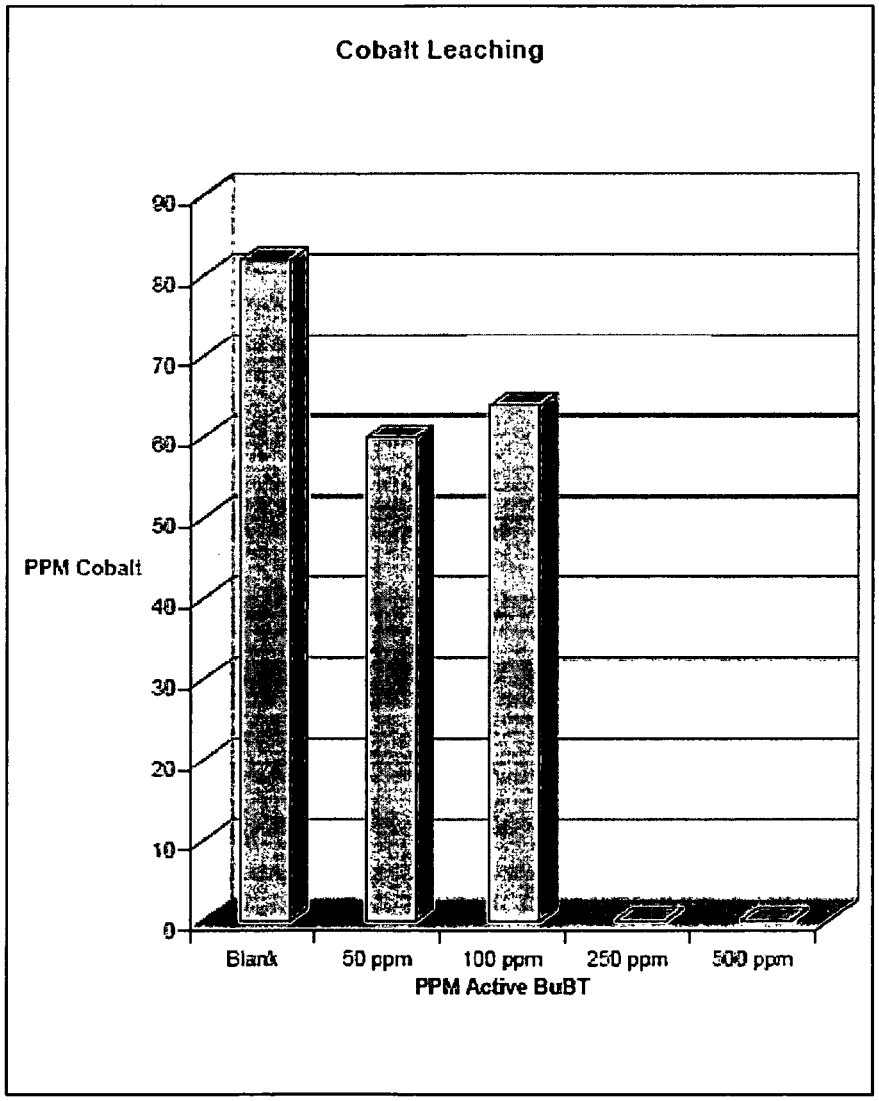
FIG. 1 is a bar graph showing the benefits of butyl-benzotriazole in reducing cobalt leaching (in ppm cobalt) at various concentrations ranging from 0 ppm (Blank) to 500 ppm.

It is advantageous to define several terms before describing the invention. It should be appreciated that the following definitions are used throughout this application.

Definitions

Where the definition of terms departs from the commonly used meaning of the term, applicant intends to utilize the definitions provided below, unless specifically indicated.

For the purposes of the present invention, the term "comprising" means various compositions, compounds, ingredients, components, elements, capabilities and/or steps, etc., can be conjointly employed in the present invention. Accordingly, the term "comprising" encompasses the more restrictive terms "consisting essentially of" and "consisting of."

For the purposes of the present invention, the term "metal working process" refers to any mechanical process which uses a metal working tool. Such processes may include, for example, drilling, milling, cutting, planing, machining, shaping, stamping, grinding, lathing, trimming, abrading, boring, reaming, polishing, turning, honing, sawing, broaching, tapping, threading etc., or any combination thereof.

For the purposes of the present invention, the term "metal working tool" refers to any tool which causes primarily physical changes, as opposed to chemical changes, to a workpiece. Metal working tools may include, for example, drills, drill presses, mills, cutters, planers, lathes, shapers, borers, reamers, grinders, stamping press, scrapers, etc.

For the purposes of the present invention, the term "metal working fluid" refers to any fluid which is liquid and which may be used in a metal working process for one or more functions, which may include cooling, lubrication, debris removal, reducing or inhibiting corrosion, reducing or inhibiting material build up on workpieces and/or metal working tools, etc. Metal working fluids may also be referred to interchangeably as a "cutting fluid," a "cutting oil," a "cutting compound," etc. The metal working fluid may be aqueous, may be an oil-in-water emulsion, may be a paste, may be a gel, may be a mist, etc. These metal working fluids may include water (for example, in amounts of from 5 to about 70% by weight, such as from about 15 to about 50% by weight of the composition), conventional coolants and lubricants such as, for example, one or more of: a monocarboxylic acid(s), which may have more than 10 carbon atoms, such as fatty acids having from 12 to 18 carbon atoms; an aromatic or paraffinic carboxylic acid, such as, for example, an alkylsulfuramido carboxylic acid, an arylsulfuramido carboxylic acid, alkenyl dicarboxylic acid, and/or a alkylphenyl carboxylic acid disclosed in, for example, U.S. Pat. No. 4,315,889 (McChesney et al.), issued Feb. 16, 1982, the entire disclosure and contents of which is hereby incorporated by reference; a nonionic alkylene oxide adduct(s) having a molecular weight of more than 400, such as, for example, polypropylene glycol or random-added polypropylene polyethylene glycols, or block copolymers of ethylene and propylene oxide sometimes referred to as poloxamers (e.g., Pluronics®), a petroleum distillate(s) (e.g., mineral oil), an animal fat(s), a plant oil(s), etc. These metal working fluids may also include anionic lubricants capable of protecting, for example, iron against corrosion. The amount of the lubricant/coolant may comprise, for example, from about 1 to about 30% by weight of the composition. The metal working fluid may also comprise an organic solvent, such as, for example, alcohols (e.g., methanol, ethanol, isopropanol, etc.), ketones, aromatics, glycols (e.g., ethylene glycol, propylene glycol, etc.), polyglycols, etc.

For the purposes of the present invention, the term "metal working tool comprising cobalt" refers to a metal working tool comprising a measurable amount of cobalt which may be leached away. For example, the metal working tool may comprise an alloy of cobalt with another metal (e.g., iron, nickel, etc.), may comprise particles bonded by cobalt (e.g., tungsten carbide particles bonded by cobalt, etc.), etc.

For the purposes of the present invention, the term "tungsten carbide particles" refers to particulate forms of tungsten, which may have a particle size in the range of from about 1 to about 15 microns, for example, from about 7 to about 9 microns. Tungsten carbide particles may also be measured in a range of mesh sizes, for example, in the range of from 40 to 80 mesh, i.e., the size of the wire mesh used to screen the tungsten carbide particles. For example, "40 mesh" indicates a wire mesh screen with forty holes per linear inch, wherein the holes are defined by the crisscrossing strands of wire in the mesh. The hole size may be determined by the number of meshes per inch and the wire size. The mesh sizes referred to herein are standard U.S. mesh sizes. A standard 40 mesh screen has holes such that only particles having a dimension less than 420 micrometers can pass. That is, particles larger than 420 micrometers in size will be retained on a 40 mesh screen, while particles smaller than 420 micrometers may pass through the screen.

For the purposes of the present invention, the term "tungsten carbide particles bonded by cobalt" refers to tungsten carbide particles held together by a cobalt bonding agent, including cemented tungsten carbide parts. Cemented tungsten carbide (also known as sintered tungsten carbide) refers to a material which may be formed by mixing particles of tungsten carbide, for example, monotungsten carbide, and particles of cobalt, and sintering the mixture. The mechanical properties of commercial grade cemented tungsten carbide may be varied within a particular envelope by adjusting the cobalt metal content and the tungsten carbide grain sizes. For example, the Rockwell A hardness of cemented tungsten carbide may be varied in the range of from about 85 to about 94, and the fracture toughness may be varied in the range of from about 8 to 19 $Mpam^2$. In a process for making cemented tungsten carbide, small tungsten carbide particles, e.g., from about 1 to about 15 microns, and cobalt particles may be vigorously mixed with a small amount of organic wax which serves as a temporary binder. The binder may be added to facilitate, for example, the flowability and cohesiveness of a part formed from the mixture. An organic solvent may also be used to promote uniform mixing. The mixture may be prepared for sintering by either of two techniques: the mixture may be pressed into solid bodies, often referred to as green compacts; alternatively, the mixture may be formed into granules or pellets, such as by pressing through a screen or tumbling, and then screened to obtain more or less uniform pellet sizes. To ensure a homogeneous mixture, the tungsten carbide, cobalt, and binder may be mixed (e.g., using a ball or attritor milled) in a liquid. The solvent may be a liquid, such as heptane, to decrease the tendency for the tungsten carbide to decarburize and for the tungsten carbide and cobalt to pick up oxygen, for example, when mixed in water or air.

For the purposes of the present invention, the term "cobalt leaching" refers to the process, effect, etc., of cobalt metal in a metal working tool, for example, cobalt used to bond tungsten carbide particles together, being stripped away, dissolved from, etc., by one or more agents, compounds, materials, etc., in a composition in contact with the metal working tool, by the metal working process of, or any combination thereof.

For the purposes of the present invention, the term "reducing cobalt leaching" refers to any measurable elimination, diminishing, lessening, moderating, lowering, etc., of the effect, process, etc., of cobalt leaching.

For the purposes of the present invention, the term "benzotriazoles" refers to one or more compounds having the general formula:

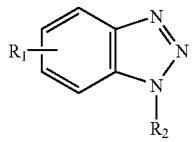

wherein $R_1$ is one or more of H, a halo group, an aliphatic group, an aromatic group or a mixture thereof, and $R_2$ is H, an aliphatic group, an aromatic group or a mixture thereof. The one or more $R_1$ groups may be at one or more of the 4, 5, 6 and/or 7 positions on the benzene ring.

For the purposes of the present invention, the term "butyl-benzotriazole" refers to benzotriazoles wherein the $R_1$ groups are such that the butyl group (e.g., n-butyl group) may be at one of the 4, 5, 6 and/or 7 positions on the benzene ring, while H is at the remainder of the 4, 5, 6, and 7 positions on the benzene rings, and wherein the $R_2$ group is H. For example, butyl-benzotriazole may be, for example, 4-butyl-benzotriazole, 5-butyl-benzotriazole, or a mixture thereof.

For the purposes of the present invention, the term "aromatic" refers to an unsaturated cyclic arene moiety containing one or more unsaturated cyclic rings (for example, 5 and/or 6 atoms per ring) that can be substituted, unsubstituted, or a combination thereof, can be heterocyclic (i.e., including one or more oxygen atoms, nitrogen atoms, sulfur atoms, etc.), nonheterocyclic, or a combination thereof, can have any desired number of carbon atoms, e.g., from 3 to 30 carbon atoms, for example, from 3 to 18 carbon atoms, e.g. from 3 to 12 carbon atoms, etc. Aromatic moieties suitable herein can include, but are not limited to, substituted or unsubstituted phenyl, naphthyl, biphenyl, binaphthyl, phenanthenryl, anthracenyl, pyridinyl, pyrimidinyl, purinyl, pyrinyl, furanyl, thiophenyl, benzofuranyl, benzothiophenyl, dibenzofuranyl, dibenzothiophenyl, imadazolyl, oxazolyl, thiazolyl, pyrazolinyl, indolyl, pyridazinyl, pyrazinyl, quinolinyl, isoquinolinyl, benzoquinolinyl, phenanthrolinyl (e.g. 1,10-phenanthrolyl), carbazolyl, etc. Suitable aromatic moieties may include, but are not limited to, halo (i.e., fluoro, chloro, bromo, iodo), alkyl (e.g., methyl, ethyl, propyl, butyl, etc.) and substituted alkyl (e.g. hydroxymethyl, hydroxyethyl, trifluoromethyl, alkoxymethyl, etc.), amino and substituted amino (e.g., dimethylamino, etc.), hydroxy (e.g., a phenol), carboxy, sulfonate, ester, amide, sulfonamide, carbamate, acyl (i.e., aldehyde or ketone), nitro, etc., or any combination thereof.

For the purposes of the present invention, the term "aliphatic" refers to a carbon-containing moiety other than an aromatic moiety. Aliphatic moieties may be straight chain, branched chain, cyclic (cycloaliphatic), or any combination thereof, can be substituted or unsubstituted, may include one or more heteroatoms (e.g. oxygen atoms, nitrogen atoms, sulfur atoms, etc.) in the carbon chain (i.e., can be heterocyclic), may be unsaturated (i.e., one, two or more double bonds) or saturated, etc, and may have any desired number of carbon atoms, e.g., from 1 to 30 carbon atoms, for example from 1 to 12 carbon atoms, such as from 1 to 7 carbon atoms, etc. Aliphatic moieties suitable herein may include, but are not limited to, substituted or unsubstituted alkyl, alkenyl, alkadienyl, alkynyl, cycloalkyl, cycloalkenyl, etc. Suitable aliphatic moieties may include, but are not limited to, halo (i.e., fluoro, chloro, bromo, iodo), alkyl (e.g., methyl, ethyl, propyl, butyl, pentyl, hexyl, heptyl, etc.) and substituted alkyl (e.g., hydroxylmethyl, hydroxyethyl, trifluoromethyl, alkoxymethyl, etc.), hydroxy, amino and substituted amino (e.g., dimethylamino, etc.), carboxy, sulfonate, ester, amide, sulfonamide, carbamate, acyl (i.e., aldehyde or keto), etc., or any combination thereof.

For the purposes of the present invention, the term "halo group" refers to a fluoro substituent, a chloro substituent, a bromo substituent, an iodo substituent, or mixture thereof.

For the purposes of the present invention, the amounts in ppm referred to herein for the triazole(s) refer to single strength usage amounts where the composition is in a ready to use form. Accordingly, the triazole(s) may be included in concentrates forms of these compositions in amounts which provide, after appropriate dilution with, for example, water, single strength usage compositions having the requisite ppm ranges of triazole(s), as hereafter specified.

For the purposes of the present invention, the formulas used in the specification, in the claims or in the drawings may represent a single compound, a mixture of compounds, etc., unless otherwise specified.

Description

Certain compounds added to compositions comprising metal working fluids may contain sequestering (chelating) agents and moieties such as sulfur, chlorine, carboxyl groups and hydroxyl ions. The presence of these sequesterants or moieties in a metal working fluid composition, as well as the mere presence of hydrogen and hydroxyl ions in a water-based metal working fluid composition, may be responsible for the leaching of cobalt from a metal working tool comprising cobalt during the metal working process. For example, when cutting, drilling or milling tools which are made up of tungsten carbide particles bonded with cobalt metal are exposed to these metal working fluid compositions containing chelating agents, sequesterants or moieties such as sulfur, chlorine, carboxyl groups and hydroxyl ions, the cobalt in the metal working tool may be leached away.

In order to minimize or reduce such cobalt leaching from metal working tools comprising cobalt, for example, tungsten carbide particles bonded by cobalt, which are in contact with such metal working fluid compositions, it has been found that using one or more of certain triazoles with or in the metal working fluid are effective in reducing cobalt leaching (during the metal working process) from a metal working tool comprising cobalt, for example, a metal working tool comprising tungsten carbide particles bonded by cobalt. In one embodiment of the present invention, a method is provided in which a metal working tool comprising cobalt, for example, a metal working tool comprising tungsten carbide particles bonded by cobalt, is contacted with a composition comprising one or more triazoles, wherein the one or more triazoles comprise at least butyl-benzotriazole and optionally one or more other benzotriazoles, in an amount effective to reduce cobalt leaching from the metal working tool during a metal working process. In an embodiment of this method, the one or more triazoles may be added to the composition prior to contacting the metal working tool with the composition, may be added or more times (e.g., periodically) to the composition during contact of the metal working tool with the composition, for example, to replenish the one or more triazoles in the composition, to increase the concentration of the one or more triazoles in the composition during one or periods in which the metal working tool is in contact with the composition, etc. In another embodiment of the present invention, a composition is also provided, which comprises: a metal working fluid; and one or more of these triazoles in an amount effective to reduce cobalt leaching from a metal working tool comprising cobalt, for example, a metal working tool comprising tungsten carbide particles bonded by cobalt.

For embodiments of the present invention, the one or more triazoles may comprise butyl-benzotriazole, such as 4-butyl (e.g. n-butyl)-benzotriazole (4-BuBT), 5-butyl (e.g., n-butyl)-benzotriazole (5-BuBT), or a mixture thereof, and optionally one or more other benzotriazoles. In addition to butyl-benzotriazole, other suitable benzotriazoles for use in embodiments of the present invention may have the formula:

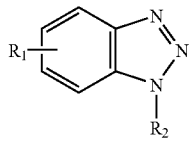

wherein $R_1$ is one or more of H, a halo group, an aliphatic group other than butyl, an aromatic group or a mixture thereof, and $R_2$ is H, an aliphatic group, an aromatic group or a mixture thereof The aliphatic group may have, for example, from 1 to 12 carbon atoms (e.g., from 1 to 7 carbon atoms, such as, for example, for $R_1$, methyl, ethyl, propyl, pentyl, hexyl, and/or heptyl), may be saturated or unsaturated, may be branched or straight chain, may be an alkyl group, an alkoxy group, carboxy group, may be substituted or unsubstituted, (such as, for example, for $R_2$, bis(2-ethylhexyl)-aminomethyl, bis(2,2'-ethanol)-aminomethyl, etc.), etc. These other benzotriazoles may include (e.g., where the $R_2$ group is H) benzotriazole ("BT"), tolyltriazole ("TT") which may be 4-methyl-benzotriazole ("4-MeBT"); 5-methyl-benzotriazole ("5-MeBT"), or a mixture thereof, chloro-benzotriazole ("ClBT") which may be 4-chloro-benzotriazole ("4-ClBTA"), 5-chloro-benzotriazole ("5-ClBT"), or a mixture thereof, chloro-tolyltriazole ("ClTT") which may be 6-chloro-tolyltriazole ("6-ClTT"); 7-chloro-tolyltriazole ("7-ClTT"), or a mixture thereof, pentoxy-benzotriazole ("Pentoxy BT") which may be 4-pentoxy-benzotriazole ("4-Pentoxy BT"), 5-pentoxy-benzotriazole ("5-Pentoxy BT"), or a mixture thereof, carboxy-benzotriazole ("Carboxy BT") which may be 4-carboxy-benzotriazole ("4-Carboxy BT"), 5-carboxy-benzotriazole ("5-Carboxy BT"), or a mixture thereof as either the acid(s) or a water-soluble salt(s) thereof (e.g., sodium salt, potassium salt, etc.); N-1-bis(2-ethylhexyl)-aminomethyl-tolyltriazole (e.g., sold by Ciba Specialty Chemicals under the trade name Irgamet 39®); N-1-bis(2,2'-ethanol)-aminomethyl-tolyltriazole (e.g., sold by Ciba Specialty Chemicals under the trade name Irgamet 42®), etc. Mixtures of benzotriazoles which may be used include, for example, 5-butyl-benzotriazole (5-BuBT) and benzotriazole (BT), 5-butyl-benzotriazole (5-BuBT) and tolyltriazole (TT), 5-butyl-benzotriazole (5-BuBT), benzotriazole (BT), and tolyltriazole (TT), etc.

The one or more triazoles may comprise from about 2 to 100% by weight (for example, for example, from about 5 to 100% by weight) butyl-benzotriazole, and from 0 to about 98% by weight (for example, from about 0 to about 95% by weight) other benzotriazoles. For mixtures of butyl-benzotriazole (for example, 5-butyl-benzotriazole), with benzotriazole and/or tolyltriazole, the butyl benzotriazole may comprise from about 2 to about 20% by weight (for example, from about 5 to about 15% by weight) of the mixture, while the benzotriazole and/or tolyltriazole may comprise from about 80 to about 98% by weight (for example, from about 85 to about 95% by weight) of the mixture. The benzotriazole and/or tolyltriazole portion of the mixture may comprise all (i.e., 100%) benzotriazole, all (i.e., 100%) tolyltriazole, or a combination of benzotriazole and tolyltriazole, for example, in a weight ratio of from about 10:1 to about 1:10, such as from about 2:1 to about 1:2 (e.g., about 1:1).

The composition comprising the one or more triazoles may be aqueous, may be oil-based, may be in the form of an oil-in-water emulsion, may be in a ready-to-use form or may be a concentrate which may be diluted, as needed, with, for example, water to provide a composition for use with the metal working tool, may comprise synthetic organic and/or hydrocarbon-based lubricants/coolants, etc. The one or more triazoles added to, or included with the compositions may comprise one type of triazole compound, or may comprise mixtures or blends of triazole compounds. The one or more triazoles may be included in/added the composition in amounts (single strength usage basis) of, for example, at least about 50 ppm of the composition, such as from about 50 to about 1000 ppm of the composition, e.g., from about 100 to about 500 ppm of the composition, such as from about 250 to about 500 ppm of the composition.

Embodiments of the compositions of the present invention comprising the one or more triazoles may also comprise other optional ingredients. For example, these compositions may comprise a metal working fluid (as previously describe); biocides, fungicides or other bactericidal agents (for example, in amounts from 0 to about 15% by weight of the composition); extreme pressure additives; antioxidants; other corrosion inhibitors besides triazoles; dyes; water conditioners; pH-controlling agents (for example, in amounts from 0 to about 15% by weight of the composition); perfumes; viscosity-controlling agents and solubility-improving agents (for example, from 0 to about 15% by weight of the composition of a low-molecular weight hydroxyl-containing compounds, such as propylene glycol, ethylene diglycol, butyl diethylene glycol, or glycerol); etc.

The embodiments of the compositions of the present invention may be used in a variety of metal working processes (operations) where metal working fluids come into contact with metal working tools.

Figure 2:
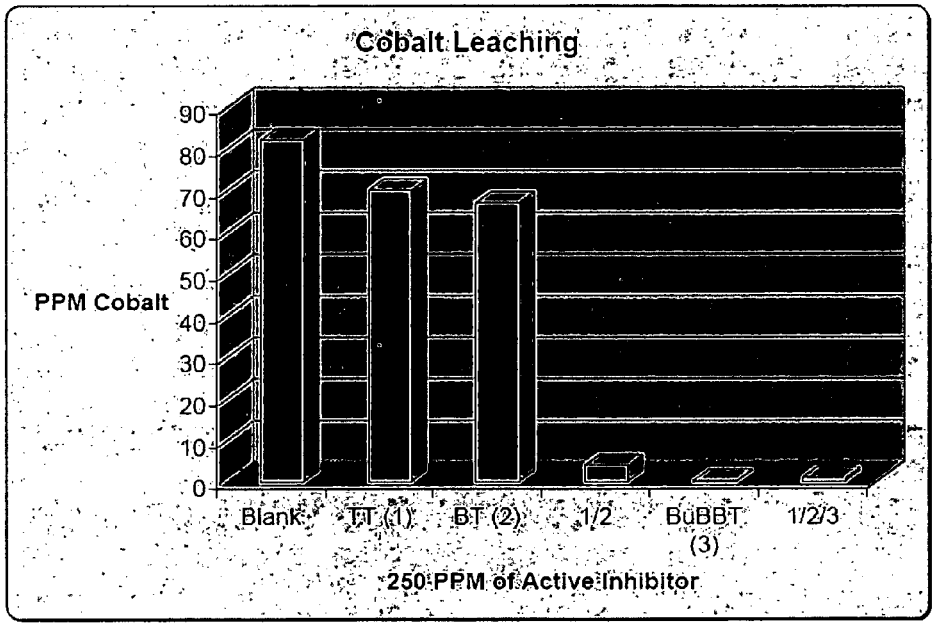
FIG. 2 is a bar graph of cobalt leaching (in ppm cobalt) in the presence of various additives.

The effectiveness of various additives in minimizing or reducing cobalt leaching from metal working tools comprising cobalt, for example, metal working tools comprising tungsten carbide particles bonded with cobalt, is illustrated in the bar graphs shown in the FIGS. 1 and 2. In carrying out the cobalt leaching testing shown in FIGS. 1 and 2, a 1% aqueous solution of monoethanolamine, as well as 1500 ppm of fine cobalt powder, are added to each of the test samples with the pH being adjusted to about 9.0 using acetic acid. Each test sample is stirred for one week, filtered and evaluated by Ion-Coupled Plasma (ICP) emission spectroscopy to determine the amount (in ppm) of cobalt that is leached out.

FIG. 1 shows the benefits of reducing cobalt leaching by using varying concentrations of a 35% sodium salt solution of butyl-benzotriazole (SA-35) from 0 ppm (Blank) to 500 ppm. As shown in FIG. 1, 82 ppm of the cobalt is leached out of the sample. As further shown by FIG. 1, the butyl-benzotriazole has at least some ability to reduce cobalt leaching at concentrations as low as 50 ppm (60 ppm of the cobalt leached out of the sample) or 100 ppm (64 ppm of the cobalt leached out of the sample), and is particularly effective in reducing cobalt leaching at concentrations as low as 250 ppm (13 ppm of the cobalt leached out of the sample) and 500 ppm (16 ppm of the cobalt leached out of the sample).

FIG. 2 which shows benefits of reducing cobalt leaching in the presence of various additives (Active Inhibitor). In FIG. 2, the samples tested included no additive (Blank), 250 ppm of tolyltriazole (TT and 1), 250 ppm of benzotriazole (BT and 2), 250 ppm of a 50/50 mixture of tolyltriazole and benzotriazole (1/2), 250 ppm of a 35% sodium salt solution of butyl-benzotriazole (SA-35), and 250 ppm of a 10/45/45 mixture of butyl-benzotriazole, tolyltriazole and benzotriazole (BuBTT and 3). As shown by the bar graph in the FIG. 2, 82 ppm cobalt is leached out in the Blank test sample, 70 ppm cobalt is leached out in the TT (1) test sample, and 67 ppm cobalt is leached out in the BT (2) test samples. The 1/2 test sample containing the 50/50 mixture of tolyltriazole and benzotriazole has 3.8 ppm cobalt leached out, while the BuBTT (3) test sample containing only butyl-benzotriazole has 0.13 cobalt leached out and the 1/2/3 test sample containing the mixture of BuBBT/TT/BT has 0.75 ppm cobalt leached out.

EXAMPLES

Example I

Oil Based Composition

An oil based composition which reduces cobalt leaching from a metal working tool comprising cobalt, for example, a metal working tool comprising tungsten carbide particles bonded by cobalt, may be prepared from the following ingredients: between 80 and 95 percent by weight of mineral oil; and between 1 and 5 percent by weight of 5-butyl-benzotriazole (optionally in combination with benzotriazole and/or tolyltriazole, as described above). Optionally other additives may be added, such as between 1 and 10 percent by weight of an extreme pressure lubricant, between 1 and 5 percent by weight of a rust preventive and between 1 and 5 percent by weight of a mist suppressant.

Example II

Oil-In-Water Emulsion Concentrate

An oil-in-water emulsion concentrate which may be subsequently diluted with water to form an oil-in-water emulsion which reduces cobalt leaching from a metal working tool comprising cobalt, for example, a metal working tool comprising tungsten carbide particles bonded by cobalt, may be prepared from the following ingredients: between 60 and 80 percent by weight of mineral oil; between 1 and 5 percent by weight of 5-butyl-benzotriazole (optionally in combination with benzotriazole and/or tolyltriazole, as described above); and between 15 and 25 percent by weight of an emulsifier (for example, sodium sulfate). Optionally there may also be added between 1 and 2 percent by weight of a bactericide (for example, Bioban P 1487), between 3 and 10 percent by weight of an extreme pressure lubricant (for example, Kloro 6001), and between 1 and 3 percent by weight of an antifoaming agent (for example, Nopco NDW available from Diamond Shamrock Corporation). The oil-in-water emulsion may be prepared by diluting the above-described concentrate with water until the concentration of triazole(s) is between about 200 and about 500 ppm.

Example III

Water-Based Concentrate and Aqueous Compositions

An water-based concentrate which may be subsequently diluted with water to form an aqueous composition which reduces cobalt leaching from a metal working tool comprising cobalt, for example, a metal working tool comprising tungsten carbide particles bonded by cobalt, may be prepared from the following ingredients: between 60 and 80 percent by weight of water; between 3 and 10 percent by weight of 5-butyl-benzotriazole (optionally in combination with benzotriazole and/or tolyltriazole, as described above), between 2 and 8 percent by weight of an aromatic or paraffinic carboxylic acid; between 2 and 10 percent by weight of boric acid; and between 5 and 20 percent by weight of an amine or mixture of amines that will react with the carboxylic (for example, a secondary or tertiary amine of sufficient reactivity to react with the boric acid and organic carboxylic acid such as di- or triethanolamine or triisopropanol amine; and 2-dimethylamino, 2-methyl, 1-propanol amine). Optionally there may be added to the concentrate between 0.1 and 5 percent by weight of a wetting agent (for example, Pluronic L-43 available from the BASF Wyandotte Corporation, and Niaproof 08 from Niacet Chemical Company); between 1 and 2 percent by weight of a bactericide and fungicide (for example, Grotan and Bioban, available from the Lehn and Fink Co., Inc., and IMC Chemicals Group, Inc., respectively); and between 1 and 2 percent by weight of an antifoaming agent (for example, SAG 30 available from Union Carbide Corporation). From this water-based concentrate, an aqueous composition may be formed by adding water to the concentrate until the concentration of triazole(s) is between about 200 and about 500 ppm.

What is claimed is:

1. A method comprising the following steps:

(a) providing a composition comprising one or more triazoles in an amount of at least about 250 ppm (single strength usage basis) effective to reduce cobalt leaching from a metal working tool comprising cobalt, wherein the one or more triazoles comprise from about 2 to 100% by weight of a sodium salt of butyl-benzotriazole, or a mixture of butyl-benzotriazole and the sodium salt of butyl-benzotriazole, and from 0 to about 98% by weight of a mixture of benzotriazole and tolyltriazole in a weight ratio of benzotriazole to tolyltriazole of from about 1:10 to about 10:1; and (b) contacting a metal working tool with the composition of step (a) during a metal working process, wherein the metal working tool comprises cobalt.

2. The method of claim 1, wherein the one or more triazoles are added to the composition periodically during step (b).

3. The method of claim 1, wherein the metal working tool contacted during step (b) is a drill, a mill, a cutter, a planer, lathes, a shaper, a borer, a reamer, a drill press, a grinder, or a stamping press.

4. The method of claim 1, wherein the one or more triazoles of the composition of step (a) comprise from about 5 to 100% by weight of the sodium salt of butyl-benzotriazole, or a mixture of butyl-benzotriazole and the sodium salt of butyl-benzotriazole, and from 0 to about 95% by weight of the mixture of benzotriazole and tolyltriazole.

5. The method of claim 4, wherein the one or more triazoles of the composition of step (a) comprise from about 5 to about 15% by weight of the sodium salt of butyl-benzotriazole, or a mixture of butyl-benzotriazole and the sodium salt of butyl-benzotriazole, and from about 85 to about 95% by weight of the mixture of benzotriazole and tolyltriazole.

6. The method of claim 5, wherein the weight ratio of benzotriazole to tolyltriazole of the composition of step (a) is in the range of from about 2:1 to about 1:2.

7. The method of claim 1, wherein the butyl-benzotriazole of the composition of step (a) is 5-butyl-benzotriazole, and wherein the sodium salt of butyl-benzotriazole is the sodium salt of 5-butyl-benzotriazole.

8. The method of claim 7, wherein the butyl-benzotriazole of the composition of step (a) is 5-n-butyl-benzotriazole, and wherein the sodium salt of 5-butyl-benzotriazole is the sodium salt of 5-n-butyl-benzotriazole.

9. The method of claim 1, wherein the one or more triazoles are added to the composition during step (a) in an amount (single strength usage basis) of from about 250 ppm to about 1000 of the composition.

10. The method of claim 9, wherein the one or more triazoles are added to the composition during step (a) in an amount (single strength usage basis) of from about 250 to about 500 ppm of the composition.

11. The method of claim 1, wherein the composition of step (a) is aqueous and comprises water in an amount of from about 5 to about 70% by weight of the composition.

12. The method of claim 11, wherein the composition of step (a) comprises a lubricant/coolant in an amount of from about 1 to about 30% by weight of the composition.

13. The method of claim 1, wherein the metal working tool of step (b) comprises tungsten carbide particles bonded by cobalt.

14. The method of claim 12, wherein the lubricant/coolant of the composition of step (a) comprises one or more of: a monocarboxylic acid; a nonionic alkylene oxide adduct; a petroleum distillate; an animal fat; or a plant oil.

15. The method of claim 6, wherein the one or more triazoles are added to the composition of step (a) in an amount (single strength usage basis) of from about 250 to about 500 ppm of the composition and wherein the butyl-benzotriazole is 4-butyl-benzotriazole, 5-butyl-benzotriazole, or a mixture thereof, and wherein the sodium salt of butyl-benzotriazole is the sodium salt of 4-butyl-benzotriazole, 5-butyl-benzotriazole, or a mixture thereof.

16. The method of claim 15, wherein the butyl-benzotriazole is 5-butyl-benzotriazole, and wherein the sodium salt of butyl-benzotriazole is the sodium salt of 5-butyl-benzotriazole.

17. The method of claim 1, wherein the composition of step (a) comprises from about 250 to about 500 ppm of the sodium salt of butyl-benzotriazole, or the mixture of butyl-benzotriazole and the sodium salt of butyl-benzotriazole.

18. The method of claim 17, wherein the one or more triazoles of the composition of step (a) comprise a mixture of from about 2 to about 20% by weight of the sodium salt of butyl-benzotriazole, or the mixture of butyl-benzotriazole and the sodium salt of butyl-benzotriazole, and from about 80 to about 98% by weight of the mixture of benzotriazole and tolyltriazole.

19. The method of claim 18, wherein the mixture of triazoles comprises from about 5 to about 15% by weight of the sodium salt of butyl-benzotriazole, or the mixture of butyl-benzotriazole and the sodium salt of butyl-benzotriazole, and from about 85 to about 95% by weight of the mixture of benzotriazole and tolyltriazole.

* * * * *